US010450095B2

(12) United States Patent
Brandhorst et al.

(10) Patent No.: US 10,450,095 B2
(45) Date of Patent: Oct. 22, 2019

(54) METHOD AND LINEAR DEVICE FOR HANDLING ARTICLES

(75) Inventors: Bjorn Brandhorst, Horstel (DE); Andreas Prahm, Barssel (DE); Frank Sachs, Saterland (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 1225 days.

(21) Appl. No.: 14/130,554

(22) PCT Filed: Jun. 5, 2012

(86) PCT No.: PCT/EP2012/002366
§ 371 (c)(1),
(2), (4) Date: Jan. 27, 2014

(87) PCT Pub. No.: WO2013/004325
PCT Pub. Date: Jan. 10, 2013

(65) Prior Publication Data

US 2014/0137515 A1 May 22, 2014

(30) Foreign Application Priority Data

Jul. 6, 2011 (DE) ..... 10 2011 107 290

(51) Int. Cl.
*B65B 13/20* (2006.01)
*B65B 35/44* (2006.01)
(Continued)

(52) U.S. Cl.
CPC ..... *B65B 13/20* (2013.01); *B65B 35/44* (2013.01); *B65B 59/005* (2013.01); *B65B 63/02* (2013.01); *B65B 63/026* (2013.01)

(58) Field of Classification Search
CPC ..... B65B 13/20; B65B 63/026; B65B 35/405; B65B 35/44; B65B 59/005; B65B 63/02
(Continued)

(56) References Cited

U.S. PATENT DOCUMENTS 2,962,848 A * 12/1960 Wilson ..... B65B 11/22 206/83.5
3,109,531 A * 11/1963 Jackson ..... B65B 35/44 198/402
(Continued)

FOREIGN PATENT DOCUMENTS

CN 102079395 A 6/2011
DE 2011921 A1 9/1971
(Continued)

OTHER PUBLICATIONS

State Intellectual Property Office of the People's Republic of China, Search Report (on related Chinese patent application No. 201280040619.4).
(Continued)

*Primary Examiner* — Gregory D Swiatocha
(74) *Attorney, Agent, or Firm* — Laurence P. Colton; Smith Tempel Blaha LLC

(57) ABSTRACT

The invention relates to a method for handling (flat) articles (10), in particular hygiene products such as diapers, napkins or the like, wherein the articles (10) are supplied on a first feed conveyor (11) and are removed as a compressed group (12) of articles (10) on a removal conveyor (14). The invention is characterized in that the feed conveyor (11) and the removal conveyor (14) are continuously driven and a group (13) of articles (10) is transferred from the continuously driven feed conveyor (11) to a continuously driven compressing device (16) in which the group (13) of articles (10) is compressed, and in that the compressed group (13) of articles (10) is transferred from the compressing device (16) to the continuously driven removal conveyor (14).

6 Claims, 5 Drawing Sheets

Figure 1:
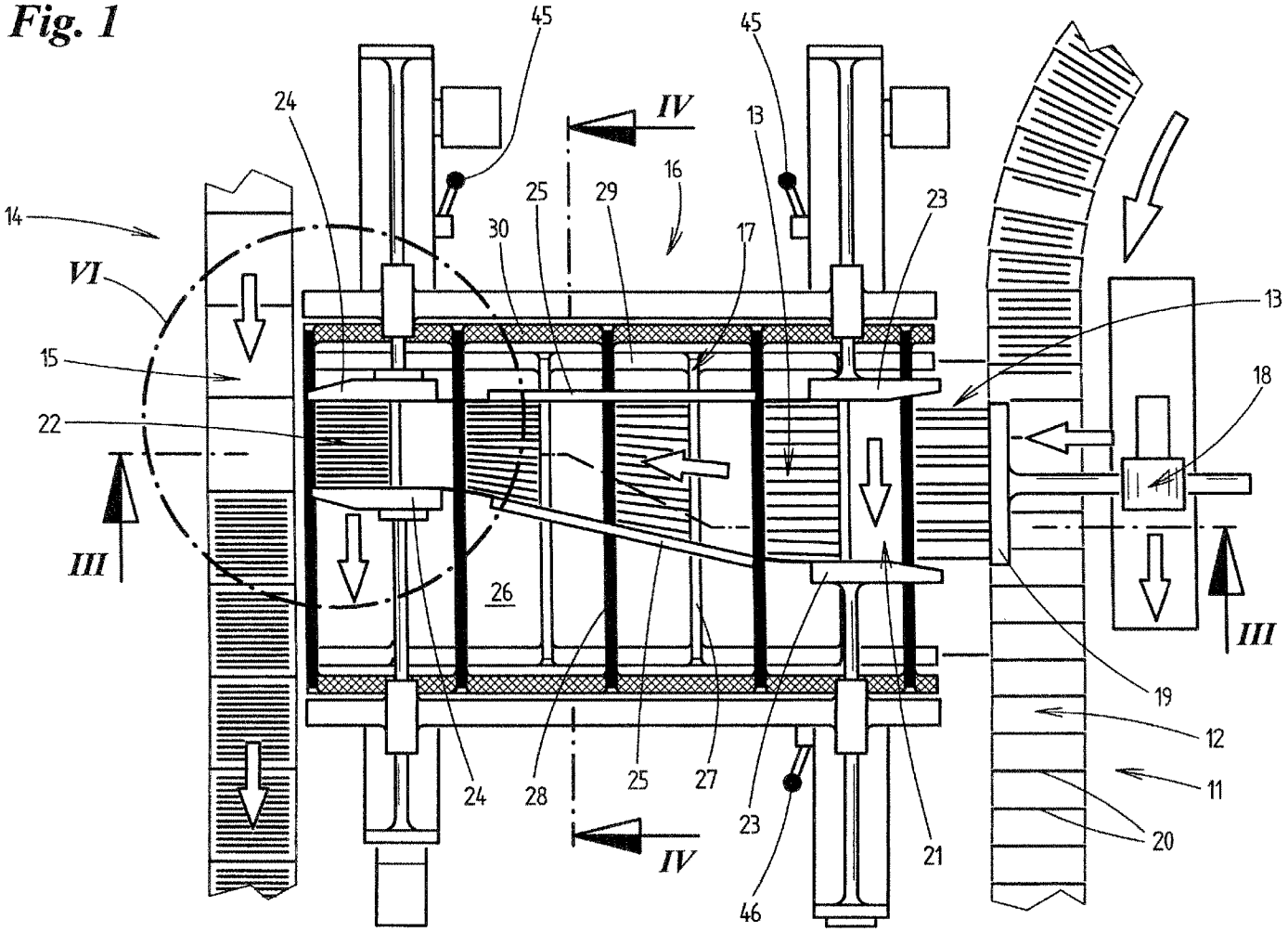

(51) Int. Cl.
*B65B 59/00* (2006.01)
*B65B 63/02* (2006.01)

(58) Field of Classification Search
USPC ..... 53/436, 438, 443–448, 152–153, 527, 53/529, 530; 100/41
See application file for complete search history.

(56) References Cited

U.S. PATENT DOCUMENTS

| | | | | |
|---|---|---|---|---|
| 3,895,476 | A * | 7/1975 | Burns, III | B65B 53/063 414/798.2 |
| 6,708,465 | B1 * | 3/2004 | Gustafsson | B65B 51/20 53/370.8 |
| 2006/0130431 | A1 * | 6/2006 | Baggot | B65B 63/02 53/439 |
| 2010/0071318 | A1 * | 3/2010 | Brandhorst | B65B 35/54 53/446 |

FOREIGN PATENT DOCUMENTS

| | | | | |
|---|---|---|---|---|
| DE | 4305127 | A1 | 2/1993 | |
| DE | 102006045087 | A1 | 3/2008 | |
| EP | 0611698 | A1 * | 8/1994 | B65B 25/146 |
| EP | 0691274 | A1 | 1/1996 | |
| EP | 0943562 | A1 | 9/1999 | |
| EP | 1050494 | A1 | 11/2000 | |
| FR | 2771375 | A1 | 5/1999 | |

OTHER PUBLICATIONS

Deutshces Patent—Und Markenamt (German Patent and Trademark Office), Recherchebericht (Search) on parent German Patent Application No. 10 2011 107 290.3 (May 9, 2012).
Intellectual Property India, Examination Report (in a related application), dated Feb. 28, 2019.

* cited by examiner

METHOD AND LINEAR DEVICE FOR HANDLING ARTICLES

The invention relates to a method for handling (flat) articles, in particular hygiene products such as diapers, napkins or the like, wherein the articles are supplied on a first feed conveyor and are removed as a compressed group of articles on a removal conveyor, as claimed in the preamble of claim 1. In addition, the invention relates to a corresponding device, as claimed in the preamble of claim 4.

Different variants of such devices and methods are known from practice. A disadvantage of the corresponding devices and methods, however, is the capacity of previous concepts which on the whole is no longer sufficient.

Proceeding from here, the object of the invention is to develop further known devices and methods, in particular with regard to greater capacity.

A method with the features of claim 1 is proposed to achieve said object. It is accordingly provided that the feed conveyor and the removal conveyor are continuously driven and a group of articles is transferred from the continuously driven feed conveyor to a continuously driven compressing device in which the group of articles is compressed, and that the compressed group of articles is transferred from the compressing device to the continuously driven removal conveyor.

In addition, it is provided that the compressing device has a continuously driven compressing conveyor, in the region of which the group of articles is compressed during the continuous conveying, wherein the compressing conveyor has lateral guides which are located opposite one another, the articles being conveyed through between said lateral guides, wherein the distance between the opposite guides is reduced over the length of the compressing conveyor for continuously compressing the group of articles when they are being conveyed on the compressing conveyor.

A characteristic consists in that the compressing conveyor has an inlet region which faces the feed conveyor and an outlet region which faces the removal conveyor, wherein the inlet region and/or the outlet region are moved together with the group of articles on the feed conveyor or to the delivery position on the removal conveyor to transfer the articles between the conveyors during the continuous conveying. The advantage of said solution is that, in particular, the articles are able to be transferred during the continuous running of the feed conveyor and of the removal conveyor.

As claimed in a preferred further development, it is provided that the inlet region and the outlet region of the compressing conveyor are moved independently of one another.

In addition, the articles are preferably arranged in compartments which are formed on the feed conveyor and are pushed out of the laterally open compartments into the inlet region of the compressing conveyor by means of a pushing device, wherein the compressing conveyor extends at an angle, in particular transversely, with respect to the feed conveyor, and in that the compressed group of articles is transferred in the outlet region of the compressing conveyor into a compartment which is formed on the removal conveyor, wherein the removal conveyor extends at an angle, in particular transversely, with respect to the compressing conveyor and preferably parallel to the feed conveyor.

A device for achieving the object mentioned in the introduction has the features of claim 4. It is correspondingly provided that the feed conveyor and the removal conveyor are set up for continuously conveying the articles or a compressed group produced of articles and that the compressing device, which is arranged between the feed conveyor and the removal conveyor, is set up for the continuous compressing of groups of articles.

In addition, it is provided that the compressing device has a continuously operating compressing conveyor, having lateral guides which are located opposite one another and are arranged converging in the direction of the removal conveyor and wherein the compressing conveyor has an inlet region which faces the feed conveyor and an outlet region which faces the removal conveyor, wherein the inlet region and/or the outlet region are movable together with the group of articles on the feed conveyor or to the delivery position on the removal conveyor for transferring the articles between the conveyors during the continuous conveyance.

In a preferred further development of the device as claimed in the invention, it can be provided that the articles rest on a conveyor path in the region of the compressing conveyor and are movable in the direction of the removal conveyor by conveying means of the compressing conveyor, wherein the conveying means are formed by conveying members which are directed transversely with respect to the conveying direction and are arranged at least in each case at the rear behind a group of articles and wherein the group of articles is preferably supported at the front by a further conveying member.

In a preferred exemplary embodiment, it can be provided that the conveying members are formed by transverse struts which are guided through recesses in the lateral guides of the compressing conveyor, and that the distance between the rear and front conveying members can preferably be modified according to the dimensions of the articles to be conveyed.

A further characteristic can consist in that lateral guides of the inlet region and/or of the outlet region are arranged in each case substantially parallel to one another and are modifiable with regard to their respective distance from one another, preferably individually, and in that the lateral guides are preferably arranged parallel to entrainment means of the feed conveyor and/or of the removal conveyor for forming laterally open compartments for several articles.

In addition, it can be significant for the lateral guides to be realized so as to be deformable in each case between the inlet region and the outlet region, in particular as a result of the articulated connection of part guides to one another and/or to the inlet region and/or to the outlet region.

Figure 2:
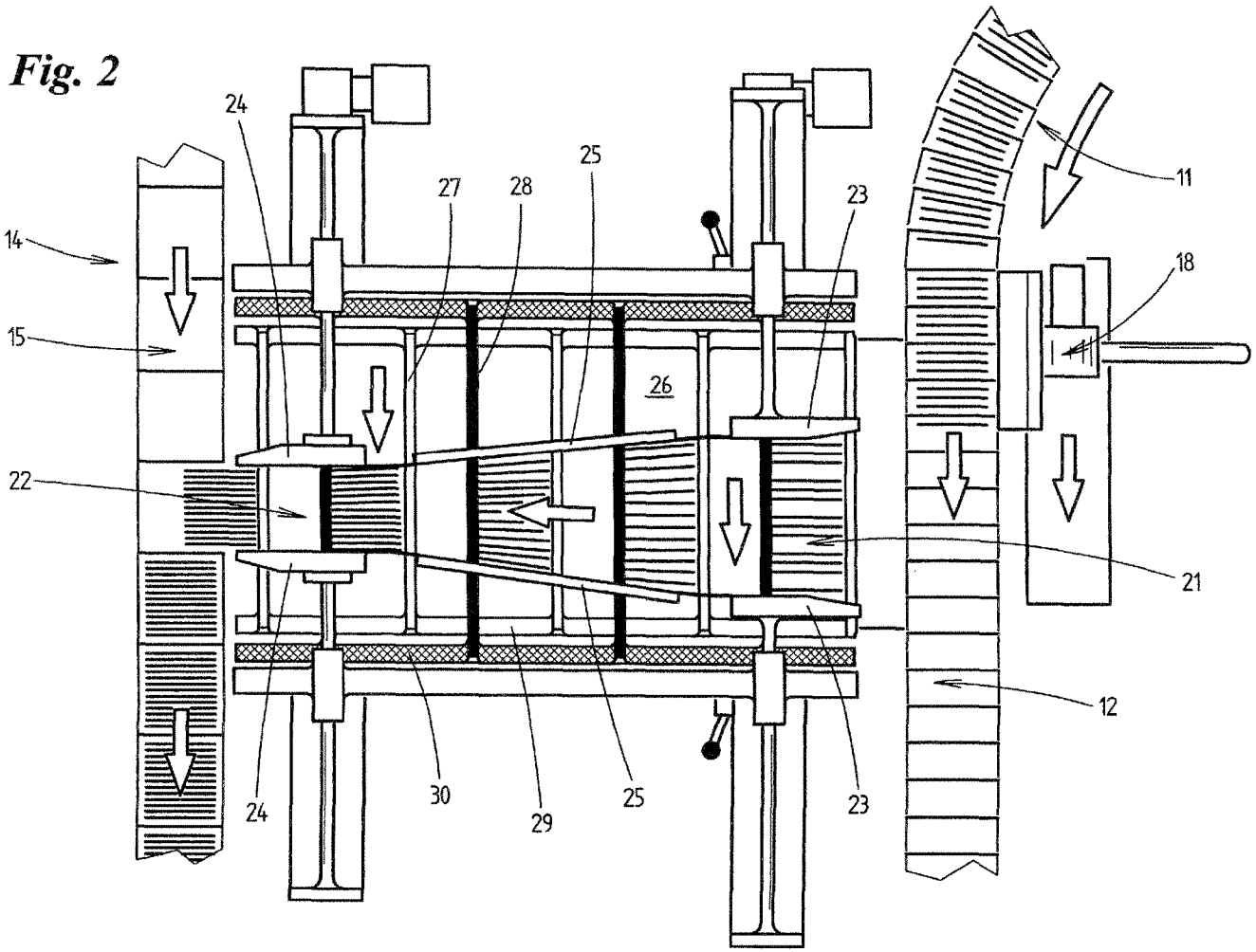
Figure 3:
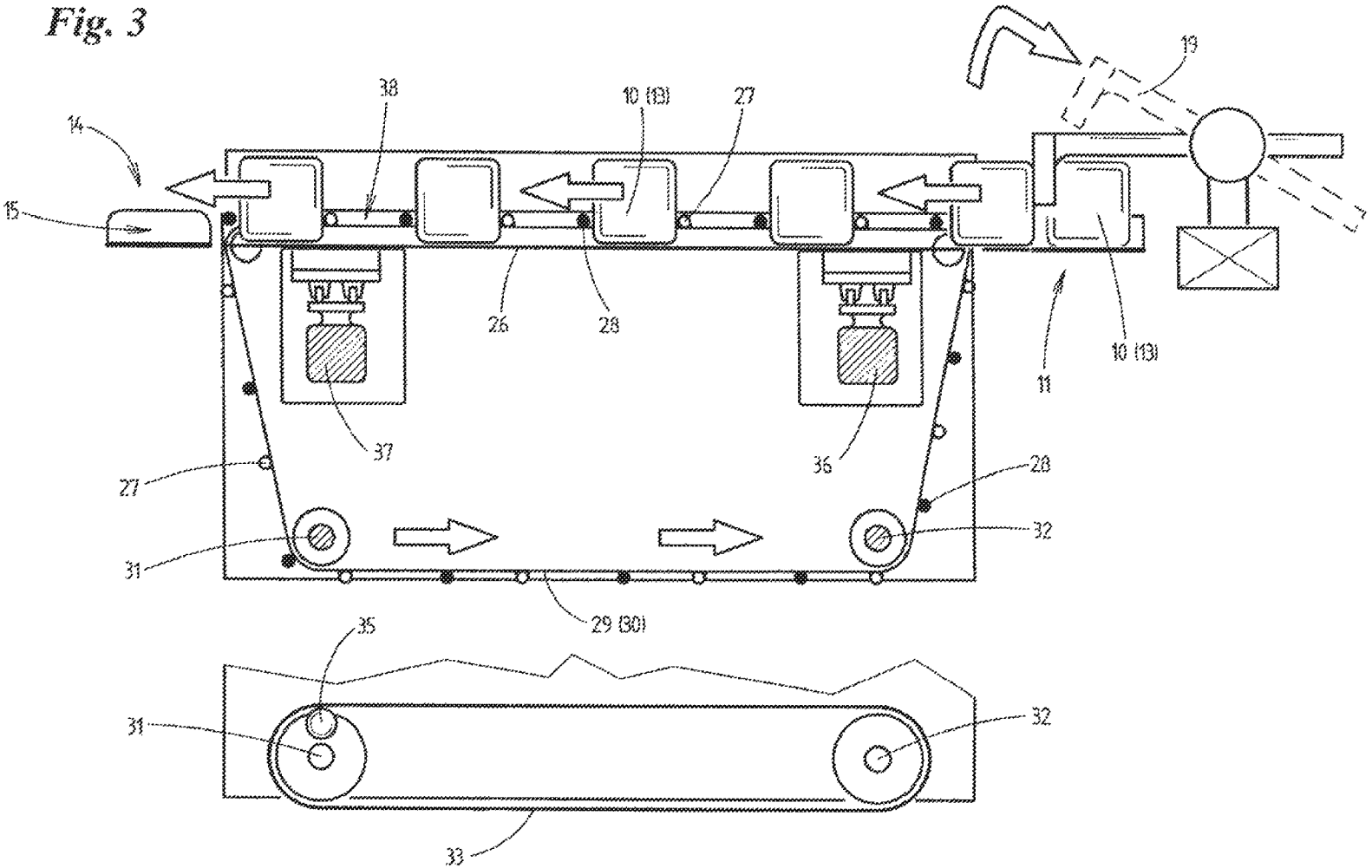
Figure 4:
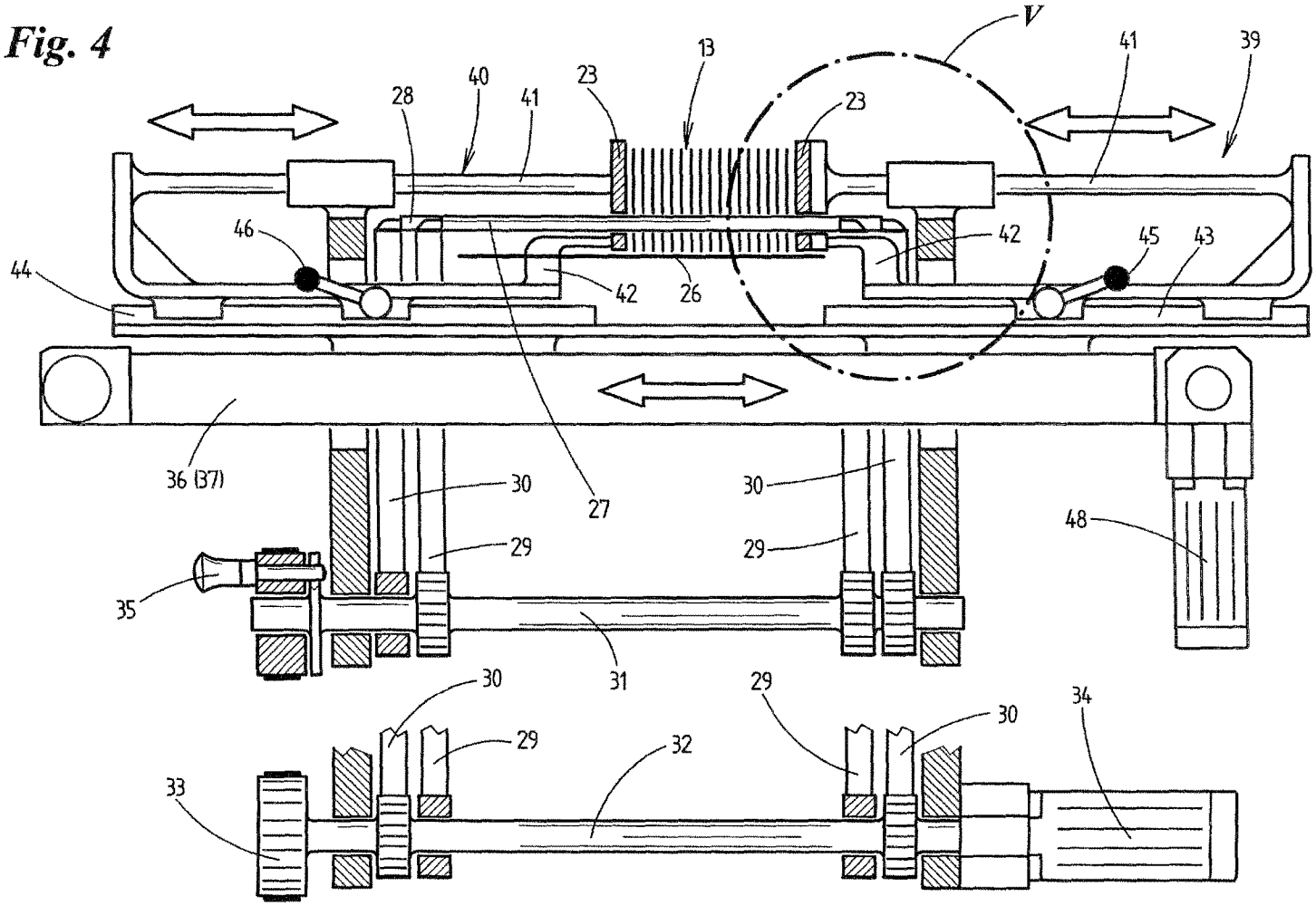
Figure 5:
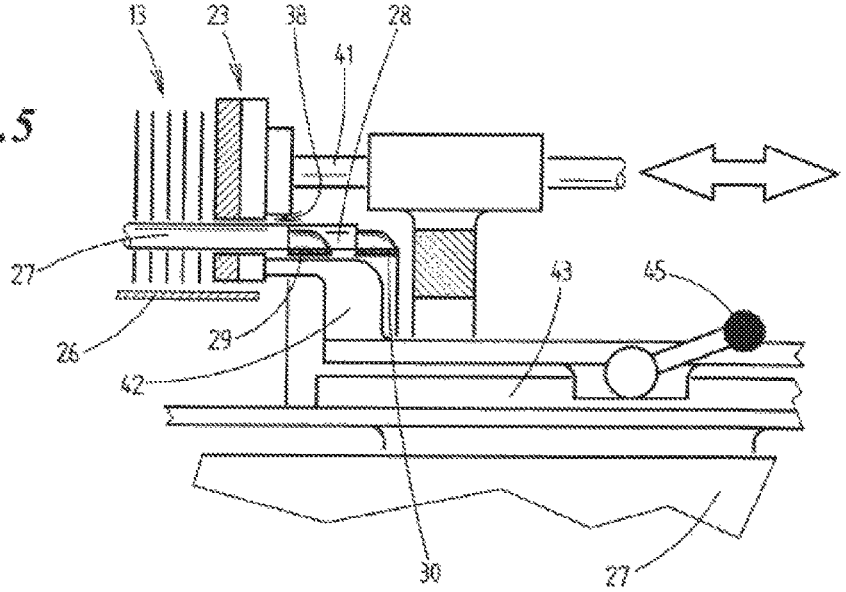
Figure 6:
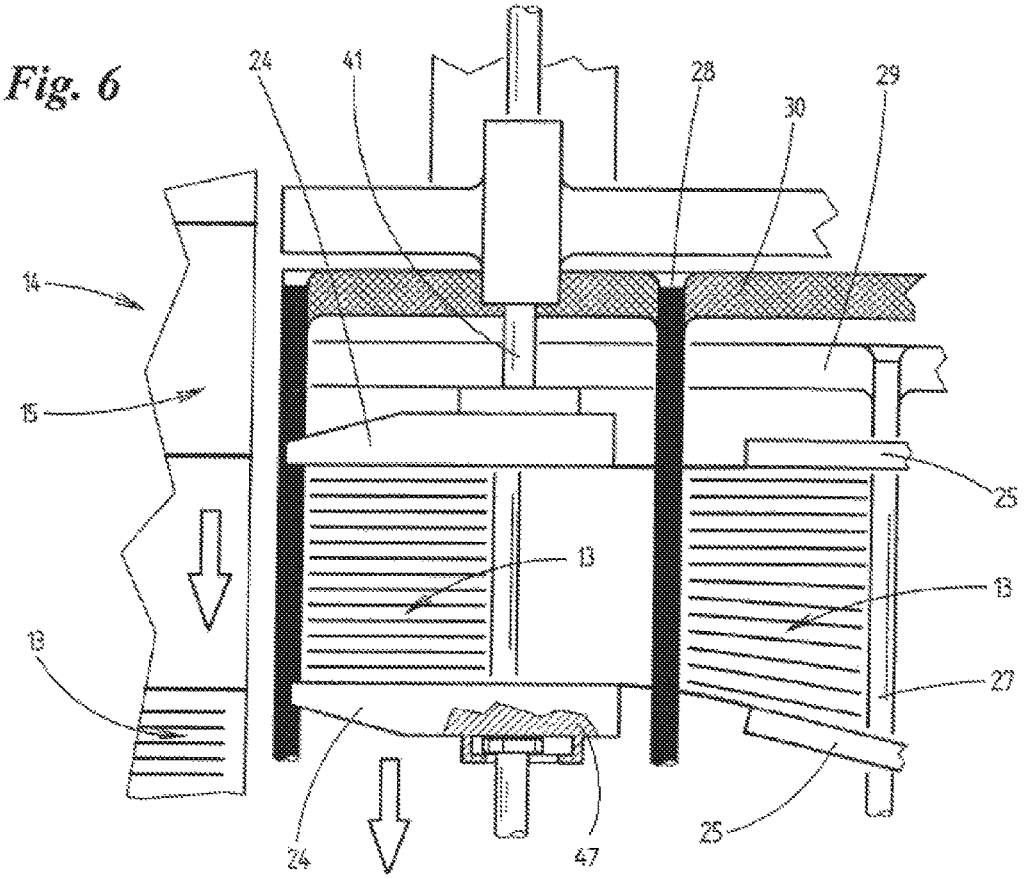

A preferred exemplary embodiment is described in detail below by way of the drawing, in which:

FIG. 1 shows a top view of a device for handling articles, when the articles are supplied from a first conveyor (feed conveyor), FIG. 2 shows the device according to FIG. 1 when the compressed articles are transferred onto a second conveyor (removal conveyor), FIG. 3 shows a vertical section through the device along the line of intersection in FIG. 1, FIG. 4 shows a vertical section through the device along the line of intersection IV-IV in FIG. 1, FIG. 5 shows a detail V of the device in an enlarged partial representation, according to the marking in FIG. 3, and FIG. 6 shows a detail VI of the device in an enlarged partial representation, according to the marking in FIG. 1.

The invention is described below by way of a device for grouping articles 10. The articles 10 can be (packaged) hygiene products such as diapers, napkins or cleansing cloths. In the present case the articles 10 are flat in form.

The articles 10 are conveyed on a continuously driven feed conveyor 11. Compartments 12, in which several articles 10 can be arranged, are formed on the feed conveyor 11. In the present case, the contents of several compartments 12 form a group 13 of articles 10 to be packaged. As an alternative to this, it is also conceivable for the contents of just one compartment 12 of the feed conveyor 11 to form the group 13.

In the exemplary embodiment shown, the articles 10 are arranged standing upright in the compartments 12. A sealing position of the articles 10 in the compartments is conceivable insofar as said compartments are completely filled. The articles 10 preferably abut against one another in the compartments 12 with their large-area (front and rear) sides. The articles 10 preferably rest on a top run of the feed conveyor 11 or of a conveyor path.

A removal conveyor 14 which is continuously driven as the feed conveyor 11 is additionally provided. Compartments 15 are also formed on the removal conveyor 14 for receiving compressed articles 10. It is provided that a compartment 15 includes in each case the number of articles 10 corresponding to the contents of a pack. As an alternative to this, it is naturally also conceivable for the contents of several compartments 15 to form the contents of the pack.

The articles 10 are also arranged standing upright in the compartments 15 on the removal conveyor 14. On account of the compressing of the articles 10, they abut against one another in a sealing position by way of their large-surface (front and rear) sides.

A compressing device 16 for compressing a group 13 of articles 10 is arranged between the feed conveyor 11 and the removal conveyor 14. To this end, during the continuous conveying, the group 13 is transferred from the feed conveyor 11 to the compressing device 16 and, after compressing, is transferred into a compartment 15 on the removal conveyor 14 which is also driven continuously at the same time.

In the present case, the compressing device 15 has a compressing conveyor 17 which conveys the group 13 of articles 10 between the feed conveyor 11 and the removal conveyor 14 and at the same time compresses them. The compressing conveyor 17 extends at an angle, preferably transversely, between the feed conveyor 11 and the removal conveyor 14, which extend parallel to one another in the region of the compressing conveyor 17. The feed conveyor 11 and the removal conveyor 14 convey the articles 10, in the present case, in the same direction. It is conceivable for the feed conveyor 11 and the removal conveyor 14 to convey the articles 10 in different, in particular opposite, directions.

To transfer a group 13 of articles 10 from the feed conveyor 11 to the compressing conveyor 17, a pushing device 18 is provided by way of which the group 13 is able to be pushed out of the compartment 12 at an angle, in particular transversely, with respect to the direction of transport on the feed conveyor 11, and supplied to the compressing conveyor 17. For this purpose, the pushing device 18 has a slide 19 which is moved laterally to abut against an upright pack edge or surface of the articles 10 and which supplies the articles 10 to the compressing conveyor 17.

The slide 19 is set up together with the articles 10 to be moved in the conveying direction of the feed conveyor 11 in order to make it possible for the articles 10 to be pushed away during the continuous conveying. To this end, the slide 19 is mounted laterally of the feed conveyor 11 in such a manner that it is movable parallel to said feed conveyor in and in opposition to the conveying direction of the same. In addition, the slide 19 is mounted so as to be displaceable transversely with respect to the conveying direction in order to push away the articles 10. In addition, the slide 19 is mounted so as to be pivotable in order to be able to be moved back into a start position once the articles 10 have been pushed away (FIG. 3). The pivot axis of the slide 19, in this case, extends parallel to the longitudinal axis of the feed conveyor 11.

The compartments 12 on the feed conveyor 11 are defined transversely with respect to the conveying direction by means of entrainment means 20. The entrainment means 20 have a smaller vertical extension than the articles 10 such that the articles 10 project above the entrainment means 20 and thus can be intercepted laterally by the slide 19 in said region.

The compressing conveyor 17 has an inlet region 21 which faces the feed conveyor 11 and an outlet region 22 which faces the removal conveyor 14. The inlet region 21 and the outlet region 22 have in each case substantially parallel, lateral guides 23, 24 for a group 13 of articles 10. The lateral guides 23, 24, are in each case aligned parallel to the entrainment means of the feed conveyor 11 and the removal conveyor 14. Lateral guides 25, which extend longitudinally of the conveying path of the group 13 of articles 10, are arranged in each case between the lateral guides 23, 24 in the inlet region 21 and the outlet region 22. The lateral guides 23, 24, 25 which are adjacent in each case are connected together in an articulated manner. To this end, the guides 23, 24 25 can be connected together by means of corresponding joints or by means of articulated intermediate pieces 47 (FIG. 6).

Coming from the feed conveyor 11, the group 13 of articles 10 is pushed by the pushing device 18 between the lateral guides 23 of the inlet region 21. The end regions of the lateral guides 23 which face the feed conveyor 11, in this case, are realized in a slightly diverging manner in order to facilitate pushing the group 11 in between the lateral guides 23. The distance between each of the lateral guides 23, in this case, corresponds to the width (size) of the non-compressed group 13 of articles 10.

The distance between the lateral guides 24 in the outlet region 22 is smaller than the distance between the lateral guides 23 and corresponds substantially to the width of a compartment 12 on the removal conveyor 14. Where applicable, the distance can be somewhat smaller than the corresponding width of a compartment 12.

The lateral guides 25, which extend between the lateral guides 23, 24 of the inlet region 21 and of the outlet region 22, extend converging toward one another such that the channel formed between the lateral guides 23, 24, 25 for the articles 10 tapers from the inlet region 21 to the outlet region 22. The group 11 is correspondingly compressed as a result of conveying the group 11 of articles 10 along the lateral guides 23, 24, 25. The articles 10, in this case, are conveyed in a continuous manner as on the feed conveyor 11 and the removal conveyor 14.

During the continuous conveying of the articles 10 on the compressing conveyor 17, the articles 10 rest on a conveyor path 26 which extends between the feed conveyor 11 and the removal conveyor 14. The group 13 of articles 10 is moved in a continuous manner between the feed conveyor 11 and the removal conveyor 14 by a conveying means. In the present case, the conveying means has, as conveying members, transverse struts 27, which are aligned transversely with respect to the conveying direction of the articles 10, abut against a group 13 at the rear in the conveying direction and push said group over the conveying path 26. Further transverse struts 28 are provided for abutting against a group 13 at the front. The transverse struts 27, 28 are arranged following one another in an alternating manner.

The two groups of transverse struts 27, 28 are driven in each case by means of conveyor chains 29, 30. The conveyor chains 29, 30 extend in each case on both sides of the conveyor path 26 and are connected to the transverse struts 27 or 28. The inner conveyor chain 29 serves for driving the transverse struts 27, whereas the outer conveyor chain 30 serves for driving the transverse struts 28. The conveyor chains 29, 30 are guided by means of guide rollers in such a manner that the transverse struts 27, 28 are guided along at a spacing above the conveyor path 26 for conveying the articles 10. A separate drive shaft 31, 32 for the conveyor chain 29, 30 is provided in each case below the conveyor path 26. Only the drive shaft 32 for the outer conveyor chain 30 is driven by a drive 35. By coupling the two drive shafts 31, 32 by means of a drive belt 33, the two drive shafts 31, 32 are moved by means of the drive 34.

Several transverse struts 27, 28 are distributed in each case at regular spacings over the circumference of the conveyor chains 29, 30. In this way, several groups 13 of articles 10 can be conveyed at the same time on the compressing conveyor 17. The distance between the transverse struts 27, 28 of the same conveyor chain 29, 30 is fixedly predetermined and cannot be modified. The distance between the transverse struts 27, 28 of the two different conveyor chains 29, 30, in contrast, can be modified. For this purpose, the relative position of the two conveyor chains 29, 30 can be modified with respect to one another and fixed by means of a latching device, in particular a latching bolt 35. In this way, the distance between consecutive transverse struts 27, can be adapted with respect to one another, depending on the length of the articles 10 to be handled in the conveying direction of the compressing conveyor 17. Slot-like openings 38, through which the transverse struts 27, 28 extend, are realized in the lateral guides 23, 24, 25.

A characteristic consists in that the inlet region 21 and the outlet region 22 are movable in each case preferably independently of one another, corresponding to the movement of the feed conveyor 11 or of the removal conveyor 14.

For this purpose, both the inlet region 21 and the outlet region 22 are movable transversely with respect to the conveying direction of the compressing conveyor 17 and are certainly movable independently of one another. To this end, the inlet region 21 is mounted so as to be displaceable along a corresponding first transverse axis 36 and the outlet region 22 is mounted so as to be displaceable along a corresponding second transverse axis 37. The transverse axes 36, 37 extend parallel to the feed conveyor 11 or to the removal conveyor 14 and are displaceable in the axial direction by means of corresponding servo drives 48.

In addition, it is provided that the distance between the lateral guides 23, 24 of the inlet region 21 and of the outlet region 22 is adjustable. For this purpose, the lateral guides 23, 24 are arranged in each case on support devices 39, 40 which are adjustable with respect to one another and which are displaceable together by moving the transverse axis. Each support device 39, 40 has two support arms 41, 42 which are connected together and, at the end of each of the support devices, supports part of the lateral guides 23, 24 above and below the openings 38 for the transverse struts 27, 28. The interconnected support arms 41, 42 are displaceable with respect to one another along clamping rails 43, 44 which are associated with the transverse axes 36, 37. The relative position of the support devices 39, 40 can be fixed with regard to the clamping rails 43, 44, preferably by means of clamping levers 45, 46.

The device described thus far operates as follows:

The articles 10 are conveyed into the compartments 12 of the feed conveyor 11 by means of a device (not shown), the articles standing upright in the compartments 12 and being arranged transversely with respect to the conveying direction. In the region of the pushing device 18, a group 13 of articles 10 is intercepted by the slide 19 and pushed into the inlet region 21 of the connecting compressing conveyor 17 during the continuous running of the feed conveyor 11. In this case, the inlet region is moved correspondingly to the movement of the group 13 together with the ram 19 such that the group 13 is pushed away during the continuous movement of the articles 10 or of the group 13.

The group 13, which is pushed in between the lateral guides 23 of the inlet region 21, is intercepted at the rear by a transverse strut 27 and pushed along the conveyor path 26. The group is guided at the front by a transverse strut 28. Whilst the group 13 is being conveyed in this manner, the group 13 is compressed by the converging lateral guides 25. As soon as the group 13 arrives in the outlet region 22, the compressing is terminated and the dimensions of the group 13 correspond to the dimension of a compartment 15 on the connecting removal conveyor 14. The compressed group 13 is pushed off into a compartment 15 of the removal conveyor 14 by means of the rear transverse struts 27. In this case, the outlet region is moved correspondingly to the continuously driven removal conveyor 14 such that the group 13 is able to be transferred during the continuous operation of the device. Afterwards, the group 13 can be transferred into a unit packaging.

Several groups 13 are able to be compressed one after another at the same time on the compressing conveyor 17. Both the inlet region 21 and the outlet region 22 are moved independently of one another, corresponding to the movement of the compartments 12, 15 on the feed conveyor 11 or the removal conveyor 14. As a result of the articulated connection between the lateral guides 23, 24, 25, the conveying channel can be adapted to the changing position of the inlet region 21 and of the outlet region 22. In addition, it is possible to provide length compensation for the lateral guides 23, 24, 25, as shown, for example, in FIG. 6. In this case, a support arm 41 (42) is fastened on a lateral guide 24 with lateral play.

To adapt to the conveying of articles 10 of other sizes, the adjusting of the distance between the lateral guides 23, 24 is provided on the one hand. In this way, the device can be adapted to a different width of the articles 10 transversely with respect to the conveying direction. On the other hand, it is possible to modify the distance between the transverse struts 27, 28 with respect to one another. In this way, the device can be adapted to a different length of the articles 10 in the conveying direction.

LIST OF REFERENCES

10 Article
11 Feed conveyor
12 Compartment
13 Group
14 Removal conveyor
15 Compartment
16 Compressing device
17 Compressing conveyor
18 Pushing device

19 Slide
20 Entrainment means
21 Inlet region
22 Outlet region
23 Guide (inlet region)
24 Guide (outlet region)
25 Guide
26 Conveyor path
27 Transverse strut
28 Transverse strut
29 Conveyor chain
30 Conveyor chain
31 Drive shaft
32 Drive shaft
33 Drive belt
34 Drive
35 Latching bolt
36 Transverse axis (inlet region)
37 Transverse axis (outlet region)
38 Opening
39 Support device
40 Support device
41 Support arm
42 Support arm
43 Clamping rail
44 Clamping rail
45 Clamping lever
46 Clamping lever
47 Intermediate piece
48 Servo drive

The invention claimed is:

1. A method for handling hygiene product articles, wherein the articles are supplied on a feed conveyor and are removed as a compressed group of articles on a removal conveyor, wherein the feed conveyor and the removal conveyor are continuously driven and a group of articles is transferred from the continuously driven feed conveyor to a continuously driven compressing device in which the group of articles is compressed, and wherein the compressed group of articles is transferred from the continuously driven compressing device to the continuously driven removal conveyor, the method comprising the steps of:

a) compressing the group of articles in the continuously driven compressing device, wherein the continuously driven compressing device has a continuously driven compressing conveyor that is located downstream of the continuously driven feed conveyor, wherein the continuously driven compressing conveyor has (a) a first pair of lateral guides that are located downstream of the continuously driven feed conveyor, (b) a second pair of lateral guides that are located downstream of the first pair, (c) a third pair of lateral guides that are located downstream of the second pair, and (d) a conveying means, the group of articles being compressed, at least in part, in between the second pair of lateral guides, as the group is conveyed down the compressing conveyor via the conveying means, wherein each pair of lateral guides, respectively, has a first lateral guide situated opposite a second lateral guide, and wherein the first pair of lateral guides, the second pair of lateral guides, and the third pair of lateral guides are configured to be adjustable perpendicular to a conveying direction of the compressing conveyor, wherein a distance between the first lateral guide and the second lateral guide of the second pair of lateral guides is reduced over a length of the continuously driven compressing conveyor, which results in the first lateral guide and the second lateral guide defining a gradual convergence in the direction of the continuously driven removal conveyor, for continuously compressing the group of articles as the group is conveyed on the compressing conveyor, wherein the continuously driven compressing conveyor has an inlet region which faces the continuously driven feed conveyor and an outlet region which faces the continuously driven removal conveyor, the first pair of lateral guides situated at the inlet region of the compressing conveyor and the third pair of lateral guides situated at the outlet region, and wherein the continuously driven compressing conveyor extends at an angle, transversely, between the continuously driven feed conveyor and the continuously driven removal conveyor, and the feed conveyor and the removal conveyor extend parallel relative to the other; and b) moving the group of articles via the continuously driven feed conveyor to a delivery position on the continuously driven removal conveyor.

2. The method as claimed in claim 1, further comprising the steps of:

arranging the articles in compartments, which are formed on the continuously driven feed conveyor;

pushing the articles out of the compartments, which are laterally open, into the inlet region of the continuously driven compressing conveyor by means of a pushing device, wherein the compressing conveyor extends at an angle, transversely, with respect to the continuously driven feed conveyor; and transferring the compressed group of articles in the outlet region of the continuously driven compressing conveyor into a compartment that is formed on the continuously driven removal conveyor, wherein the removal conveyor extends at an angle, transversely, with respect to the compressing conveyor and parallel to the continuously driven feed conveyor.

3. A device for handling flat hygiene product articles, said device comprising:

a continuously driven feed conveyor for conveying the articles;

a compressing device, which is arranged downstream of the feed conveyor, for compressing a group of the articles, the compressing device comprising (a) a continuously driven compressing conveyor, (b) a first pair of lateral guides downstream of the feed conveyor, (c) a second pair of lateral guides downstream of the first pair, (d) a third pair of lateral guides downstream of the second pair, and (e) a conveying means, wherein each pair of lateral guides, respectively, has a first lateral guide situated opposite a second lateral guide, and wherein the group is compressed in between the second pair of lateral guides as the group is conveyed down the compressing conveyor via the conveying means; and a continuously driven removal conveyor, which is arranged downstream of the compressing device, for conveying the compressed articles, wherein the continuously driven compressing conveyor has an inlet region that faces the continuously driven feed conveyor and an outlet region that faces the continuously driven removal conveyor, the first pair of lateral guides situated at the inlet region of the compressing conveyor and the third pair of lateral guides situated at the outlet region;

wherein the compressing conveyor extends at an angle, transversely, between the continuously driven feed conveyor and the continuously driven removal conveyor, and the feed conveyor and the removal conveyor extend parallel relative to the other;

wherein, in the region between the inlet region and the outlet region of the compressing conveyor, a distance between the first lateral guide and the second lateral guide of the second pair of lateral guides is gradually reduced over a length of the compressing conveyor, which results in the first lateral guide and the second lateral guide of the second pair of lateral guides defining a gradual convergence in the direction of the removal conveyor; and wherein the first pair of lateral guides, the second pair of lateral guides, and the third pair of lateral guides are configured to be adjustable perpendicular to a conveying direction of the compressing conveyor.

4. The device as claimed in claim 3, wherein:

the conveying means are formed by conveying members that are directed transversely with respect to the conveying direction of the conveying means and are arranged at an upstream position behind the group of articles; and the group of articles is supported at a downstream position by a further conveying member.

5. The device as claimed in claim 4, wherein:

the conveying members are formed by transverse struts that are guided through recesses in the lateral guides of the compressing conveyor; and the distance between the upstream and downstream conveying members is modifiable according to the dimensions of the articles to be conveyed.

6. The device as claimed in claim 3, wherein the first lateral guide and the second lateral guide of the second pair of lateral guides of the compressing conveyor comprise an articulated connection and are configured to deform due in part to the articulated connection.

* * * * *